US005765694A

United States Patent [19]

Blalock et al.

[11] Patent Number: 5,765,694

[45] Date of Patent: Jun. 16, 1998

[54] SEED COTTON MODULE HANDLER AND TRASH SEPARATOR

[75] Inventors: Billy Joe Blalock, Albany; Danny Hugh Harrell, Camilla, both of Ga.

[73] Assignee: Harrell Company, Inc., Pelham, Ga.

[21] Appl. No.: 496,828

[22] Filed: Jun. 29, 1995

Related U.S. Application Data

[63] Continuation-in-part of Ser. No. 388,260, Feb. 13, 1995, Pat. No. 5,537,809.

[51] Int. Cl.[6] ..... B03B 9/00

[52] U.S. Cl. ..... 209/2; 209/3; 209/12.1; 209/31; 209/44.1; 241/69; 241/77; 241/79; 241/81

[58] Field of Search ..... 209/2, 3, 12.1, 209/30, 31, 44.1, 616, 615, 667, 671, 672, 142, 274; 241/69, 77, 78, 79, 81, 101.01, 605; 19/80 A

[56] References Cited

U.S. PATENT DOCUMENTS

| | | | |
|---|---|---|---|
| 5,121,841 | 6/1992 | Harrington et al. | 209/616 |
| 5,222,675 | 6/1993 | Stover | 209/616 X |
| 5,537,809 | 7/1996 | Blalock | 56/16.6 |

FOREIGN PATENT DOCUMENTS

| | | | |
|---|---|---|---|
| 214054 | 3/1961 | Austria | 209/31 |

*Primary Examiner*—David H. Bollinger
*Attorney, Agent, or Firm*—Isaf, Vaughan & Kerr

[57] ABSTRACT

An infeed conveyor feeds seed cotton modules successively to a feeder head having disperser drums which reduce the modules to clumps of cotton. Incorporated into the conveyor are fluted rollers and beater rollers which cooperate to agitate the bottom portion of the modules and work the fibers on the bottom of each module so as to stretch and relax these fibers, thereby causing the sand, dirt, mud, trash and other debris accumulated along the bottom of the modules to be released. A conveyor feeds this debris to a hopper. Further, after the cotton modules have been dispersed into clumps of cotton by disperser drums in a feeder head and the clumps deposited in a clump chamber, a trough having a sieve means receives the clumps of cotton. In the trough, a conveyor disposed in the trough urges the clumps of cotton in a lateral direction toward an air separator box adjacent the feeder head. The movement of the cotton in the trough allows sand, dirt and other debris released from the clumps of cotton to pass through the sieve means in the trough. The clumps of cotton removed from the feeder head are introduced into an air separator box where additional contaminants are removed from the dispersed cotton prior to delivery to a cotton gin.

16 Claims, 7 Drawing Sheets

SEED COTTON MODULE HANDLER AND TRASH SEPARATOR

This is a Continuation-In-Part of application Ser. No. 08/388,260, filed Feb. 13, 1995 for "Seed Cotton Module Handler With Trash Separator", now U.S. Pat. No. 5,537,809.

FIELD OF INVENTION

This invention relates to a seed cotton module handler, and is more particularly concerned with a system and process for removing debris, such as dirt, sand, mud, trash and other foreign matter from seed cotton modules as the seed cotton modules are fed successively along a prescribed path toward a feeder head, and then, after the cotton modules have been broken up into clumps of cotton by a feeder head, removing additional debris from the clumps as they are fed toward the cotton gin.

BACKGROUND OF THE INVENTION

The prior art has recognized the fact that, before seed cotton modules are delivered to a gin, they are, at times, stored on the ground or on a slab so that the lower portions of the modules become wet and impregnated with debris, such as dirt, sand, mud, trash and other accumulated particles of foreign matter. It is common for the modules to have been stored out-of-doors on the slabs or on the ground or in fields, prior to the time they are transported to the gin. As a result of such storage, the modules have the debris retained by the fibers primarily along and adjacent to the bottom surface of the module. In addition, debris is also splashed, blown or otherwise introduced throughout the modules, particularly about the vertical sides of the modules which are often left exposed. Such contaminated modules, when fed directly into the feeder head, may damage the cutters of the feeder head and the debris may be passed, with the cotton clumps, along ducts where the sand or other particles abrade the elbows and fan of the duct.

In the past, efforts have been made to slice a bottom portion of the module from the remaining module as or prior to its being disintegrated by the feeder head.

U.S. Pat. No. 5,121,841 issued Jun. 16, 1992, to Harrington, et al., for example, discloses a method and apparatus for separating the more contaminated bottom portion of the seed cotton modules from the upper portion. In this patent, a process is described for slicing the bottom portion of the module body away from the remainder of the body, as the main portion of the body is reduced to small clumps of cotton at the feeder head. In this prior art system, the bottom portion which has been sliced away from the remainder of the module is fed along a separate path, away from the cotton clumps, and the removed cotton is discarded.

U.S. Pat. No. 5,222,675, issued Jun. 29, 1975, to Stover, addresses the problem by providing an arrangement, upstream from the feeder head, which shaves the bottom portion of the module to remove a part of the bottom portion which contains the wet and/or dirty cotton. Both of these prior art apparatuses remove a substantial part of the bottom portion of the cotton module from the upper portion of the module or from the cotton clumps derived from the module. Waste cotton from the Stover process is conveyed away from the remainder of the cotton or cotton clumps of the module.

SUMMARY OF THE INVENTION

Briefly described, the present invention seeks to retain and use substantially all of the seed cotton while separating the dirt, sand, mud, trash and debris (collectively referred to hereinafter as contaminants) from the bottom portion of the module and from the dispersed clumps of cotton passing from the feeder head to the gin. The present invention accomplishes this removal of such contaminants by first agitating, beating, stretching and contracting the seed cotton along the bottom of each module so as to loosen and release such contaminants; then secondly, sieving contaminants from the dispersed clumps of seed cotton as the cotton clumps are directed from the feeder head and thereafter air separating additional contaminants by air agitating these clumps.

The apparatus for removing contaminants from the bottom of the modules includes: an infeed conveyor having irregularly shaped (non-round) rollers which lift, vibrate, beat and stretch the bottom fibers of the cotton module as the modules are passed along a path of travel, so as to dislodge from this lower portion of the modules a substantial amount of the contaminants previously picked up by the cotton modules. A plurality of these non-round, live rollers are arranged in juxtaposed, parallel relationship and thus convey the modules over an upstream portion forming a cleaning bed section, whence they are delivered successively to cylindrical live rollers which feed the modules successively to the feed header at the downstream end. Most, or all, of these non-round rollers are fluted rollers formed by cylindrical drums, each drum being provided with an array of outwardly protruding, transversely disposed, equally circumferentially spaced, beater bars which successively lift, engage and beat the lower surface of each module as it is fed toward the header. These beater bars are usually equally spaced from each other around the periphery of each drum so as to protrude outwardly from the surface of the drum, itself. These beater bars extend in an axial direction with respect to the axes of the roller, across substantially the entire length of each drum. The upper flight of the fluted rollers and the live cylindrical infeed rollers define an essentially horizontal bed across which the cotton modules are successively fed.

Interspersed between the live fluted rollers are the live beater rollers, each of which, in cross-section, is preferably square These beater rollers are usually raised above the fluted rollers and can be driven at a less peripheral speed than the peripheral speed of the fluted rollers. The beater rollers have flat rectangular plates, disposed parallel to the axes of the fluted rollers, each plate being joined along both edges to other similar plates to define parallel circumferentially equally spaced peaks or apexes. These beater rollers stretch and contract the fibers along the bottom of the module.

Any contaminants which are removed from the bottom of the module, in their first cleaning stage, fall by gravity onto the walls of a funnel shaped trough and are directed onto a cross-conveyor which conveys the contaminants sideways, away from and beneath the cleaning bed section of the infeed conveyor.

At the downstream end of the conveyor, the disperser of the feeder head reduces the modules into clumps which are subjected to further cleaning in a second cleaning stage by sieving action. The apparatus to achieve the sieving action includes an upwardly opening, arcuate, trough with a grate, the trough being positioned below and on the downstream side of the disperser so that the clumps are received in the trough. The trough has a transversely disposed screw conveyor or auger rotatable therein. A portion of the trough which has the grate provides the sieving action for permitting the contaminants to be removed by gravity from the clumps as they are conveyed by the auger over the grate. The grate preferably comprises a plurality of spaced, straight, parallel rods, disposed partially around the lower portion of the auger, in an arcuate array, each rod being parallel to the axis of the auger. The grate allows relatively light contaminants, such as dirt and sand, to fall from the cotton as the cotton is tumbled and conveyed by the auger or screw conveyor laterally from beneath the disperser.

Next, the cotton clumps are subjected to a third cleaning stage by being fed by the auger into an air separator box which subjects the cotton clumps to a swirling air action causing additional contaminants to be separated from the cotton clumps before the clumps are passed to the gin. In the air separator box, an air draft is created at the end portion of the auger to force the cotton into the air box and, thence, from the air separator box through a duct toward the gin, the clumps being in a loosened condition. The heavier contaminants removed from the dispersed cotton accumulates by gravity on and remains in the bottom of the air separator box, for subsequent manual or automated removal.

Accordingly, it is an object of the present invention to provide a simple, yet effective, method and apparatus for removing sand, dirt, trash and debris (contaminants) from seed cotton module as the seed cotton module is being fed along a prescribed path and is dispersed into clumps, and from the clumps as they are conveyed toward the gin.

Another object of the present invention is to provide an apparatus which will automatically cause a removal of much of the contaminants accumulated on and in a seed cotton module before the dispersed cotton is fed to a gin.

Another object of the present invention is to provide an inexpensive method and apparatus for removing the accumulated contaminants from the seed cotton without appreciably removing the fibers of the seed cotton.

Another object of the present invention is to provide an apparatus which will remove contaminants from dispersed cotton clumps, as the cotton clumps are conveyed from beneath the disperser of a feeder head to the gin, without the appreciable loss of cotton.

Other objects, features and advantages of the present invention will become apparent from the following description when considered in conjunction with the accompanying drawings, wherein like characters of reference designate corresponding parts throughout the several views.

DETAILED DESCRIPTION

Figure 1:
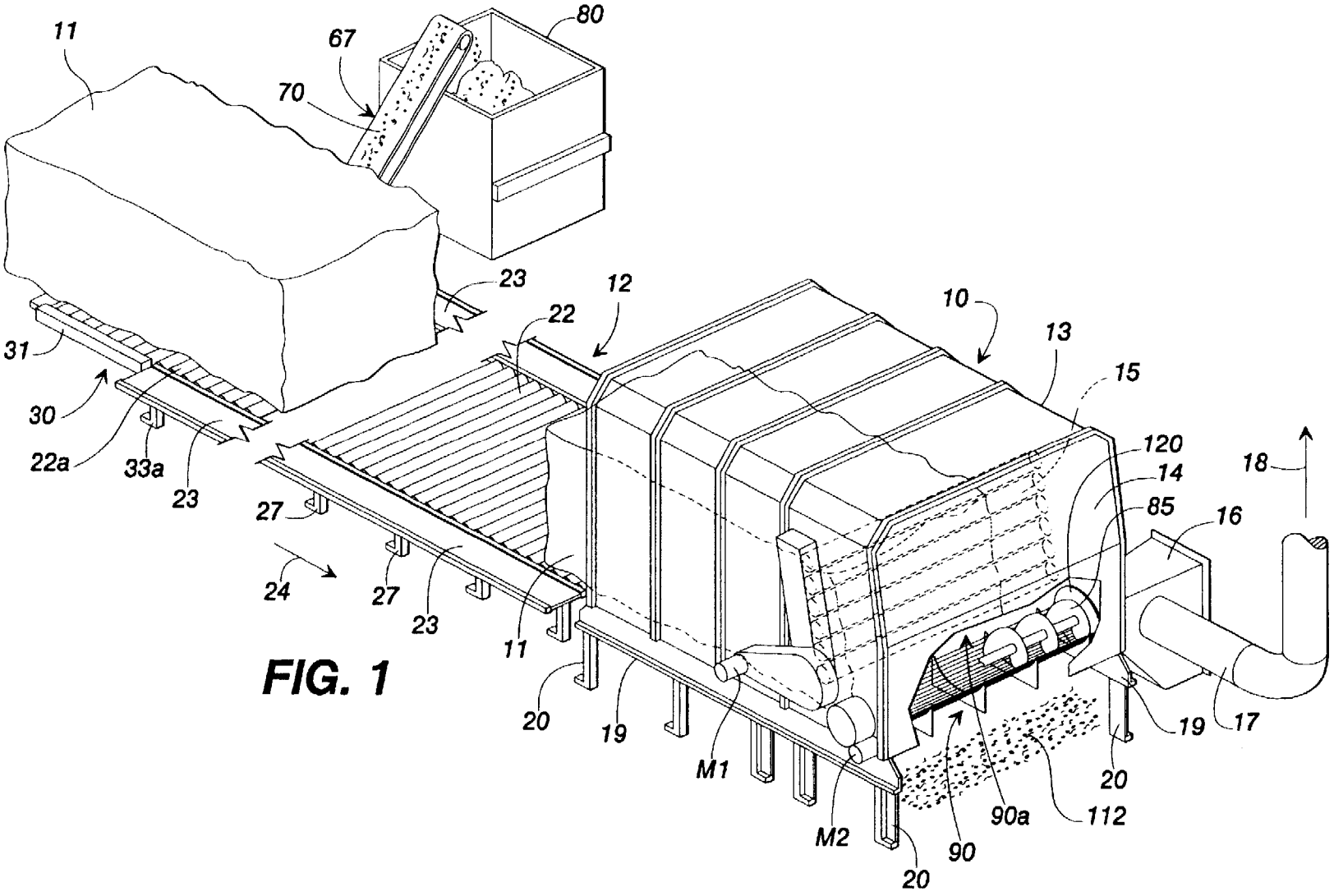
FIG. 1 is a fragmentary and partially cut-away perspective view of a portion a seed cotton module handler, having an infeed conveyor constructed in accordance with the present invention, conveying successive seed cotton modules to a feeder header, having a cross feed screw conveyor in a cleaning trough and an air separator constructed in accordance with the present invention.

Referring now in detail to the embodiment herein chosen for the purpose of illustrating the preferred embodiment of the present invention, numeral 10 in FIG. 1 denotes generally a feeder head at the downstream end of the cotton module infeed conveyor 12 of a cotton handler. Feeder head 10 includes an inverted U-shaped hood 13, the rear end portion of which is closed by an end plate 14 to form a cotton clump chamber 90*a*. Within the hood 13 is a module disperser having a plurality of transversely disposed, parallel, vertically spaced, disperser drums 15, the axes of which are arranged in an inclined plane at the downstream end of infeed conveyor 12 so that the uppermost disperser drum 15 will be first to engage the uppermost portion of the incoming seed cotton module 11 and the other lower disperser drums 15, thereafter progressively engage successive lower portions of the module 11, as the module 11 is fed into the feeder head 10. A motor M1 drives all of the disperser drums 15 while a motor M2 drives a transversely disposed auger or screw conveyor 85 in a trough 90 for delivering the clumps of cotton (not shown), removed from the cotton module 11 by the disperser drums 15, sideways into an air separator box or housing 16, the cotton clumps (not shown) then being delivered through a duct 17 to the cotton gin (not shown) by an air draft therein, these clumps traveling in the direction of arrow 18. In the trough 90 and subsequently in the air separator box 16, loose contaminants from the cotton clumps will be separated by gravity from these clumps. The hood 13 is supported in its inverted position by means of a pair of spaced parallel beams 19 which, in turn, are supported on upright legs 20.

The infeed conveyor 12 is essentially conventional and includes a horizontal, rectangular, conveyor frame 26 supported by legs 27 and having a plurality of infeed rollers 22, 22*a*, the axes of which are disposed transversely in side-by-side spaced relationship, so as to provide horizontal, upper conveying surfaces formed by the upper peripheries of the rollers 22, 22*a*. Roller 22*a* is the first roller in the group of rollers 22. These rollers 22, 22*a* are live rollers, in that they are simultaneously rotated by a motor (not shown) at uniform speeds so that the modules 11, carried on the upper peripheries of the rotating rollers 22, are urged from the upstream end of the conveyor 12, at roller 22*a*, toward and into the feeder head 10 and against disperser drums 15 at the downstream discharge end of conveyor 12.

Figure 2:
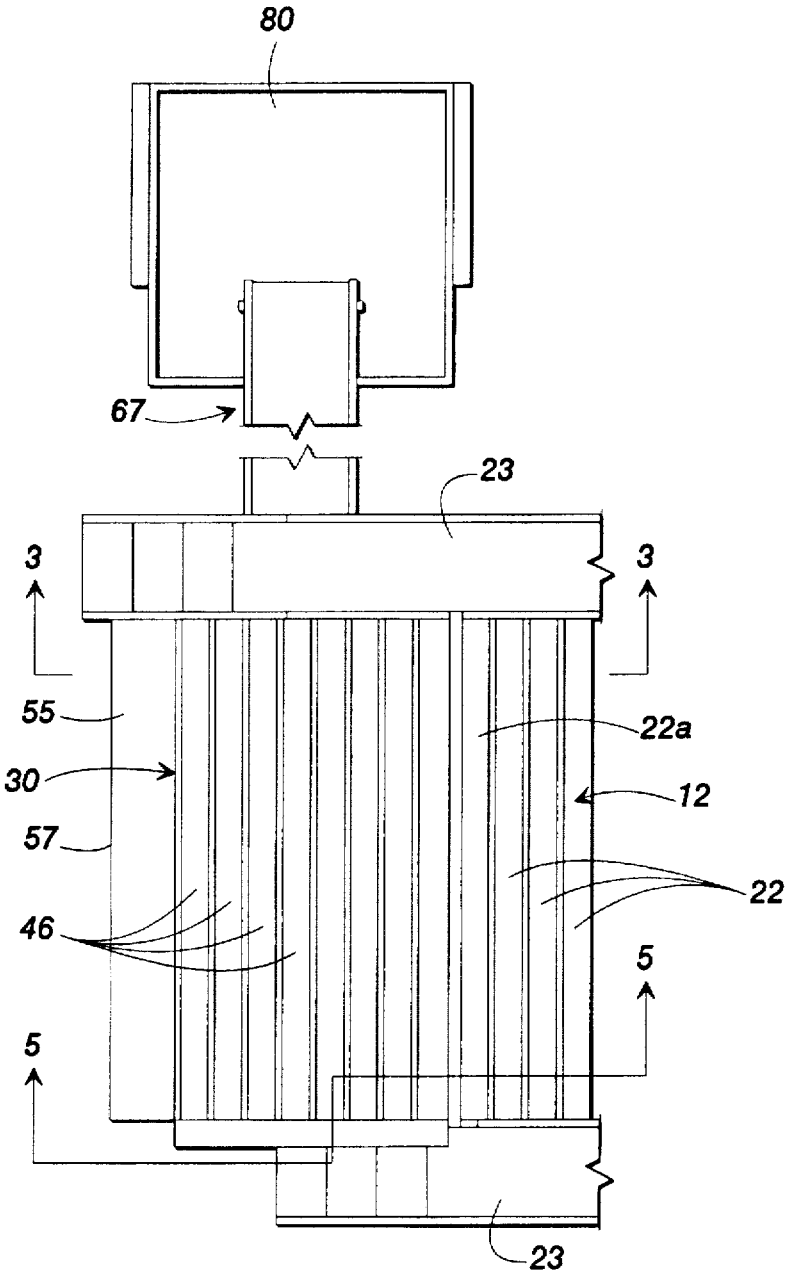
FIG. 2 is a plan view of the cleaning bed section in an entrance end portion of the infeed conveyor of the seed cotton module handler depicted in FIG. 1 and showing sidewalks along the sides of the infeed conveyor.
Figure 6:
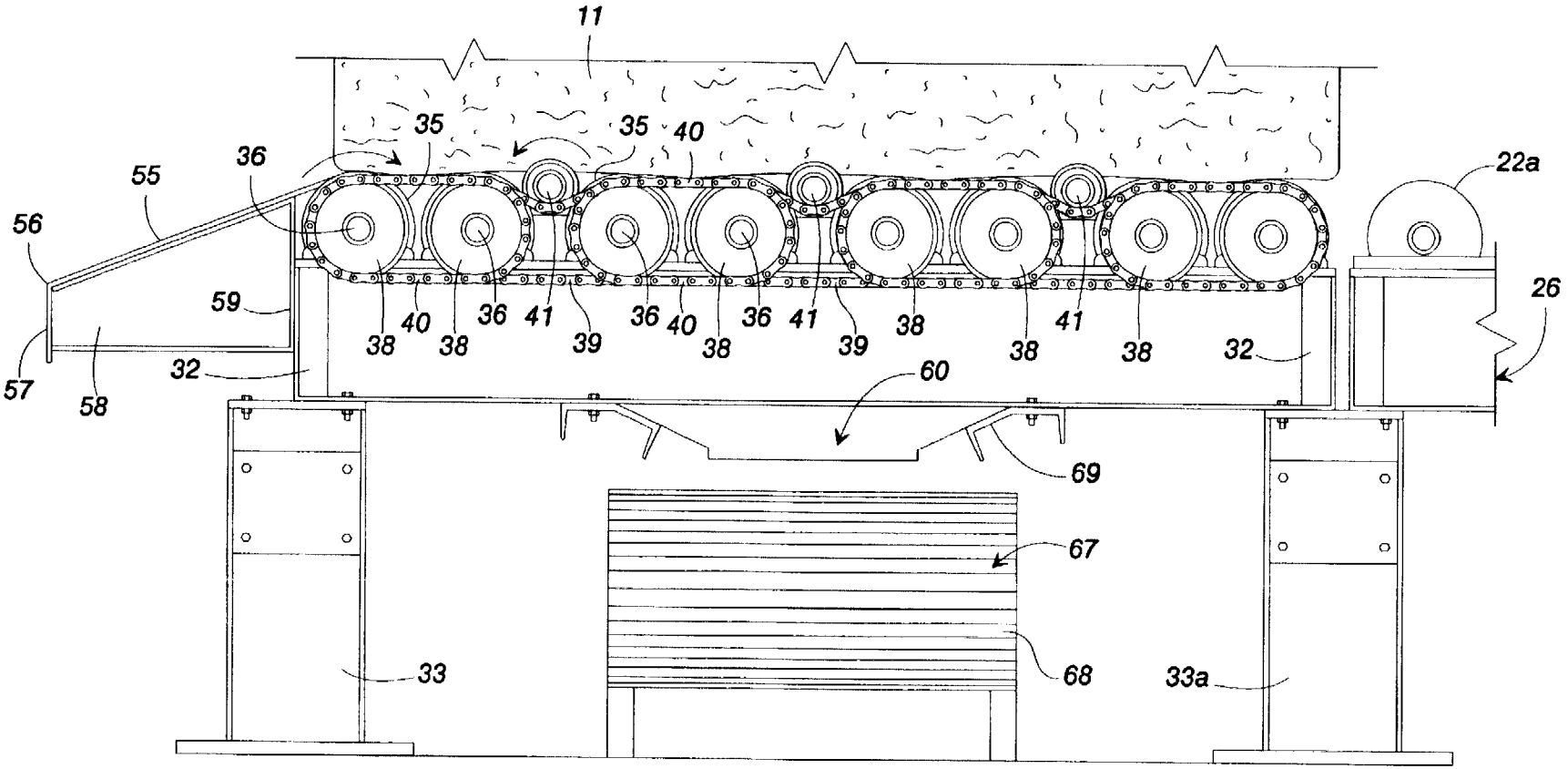
FIG. 6 is a view similar to FIG. 5 and showing the drive of the beater rollers for rotating them in an opposite direction from the fluted rollers in FIG. 5.

Walkways 23, seen in FIGS. 1 and 2, are provided on the sides of the infeed conveyor frame 26, seen in FIG. 6 for permitting access to the modules 11, as they are fed along the rollers 22, 22*a*.

The upper peripheries of the rollers 22, 22*a* are disposed in a common, essentially horizontal, plane to facilitate the feeding of the modules 11 in the direction of the arrow 24, in FIG. 1. The structure, thus far described, is essentially conventional.

Figure 3:
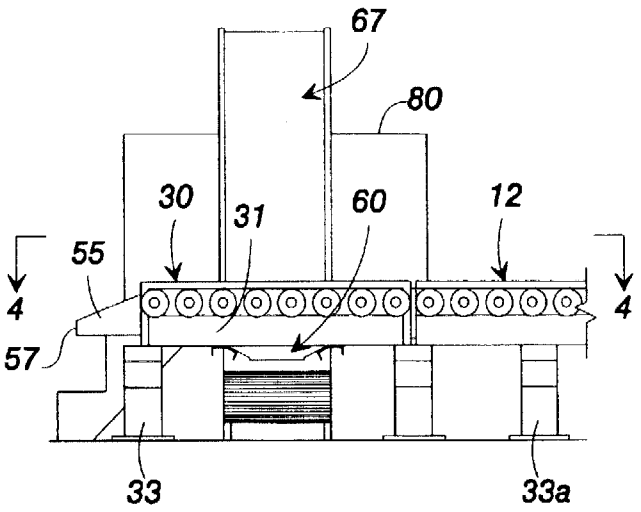
FIG. 3 is a cross-sectional view taken substantially along line 3—3 in FIG. 2.

According to the invention disclosed in the present application, a cleaning bed section, denoted generally by numeral 30, is installed in front of roller 22*a* of the infeed conveyor 12 as depicted in FIGS. 1, 2 and 3. This cleaning bed section 30 includes a pair of opposed, parallel, longitudinally extending, support beams, such as beams 31 seen in FIGS. 3 and 5, the ends of which are joined by cross beams 32 to form a rectangular frame. This rectangular frame is supported at its upstream end by appropriately placed, upstanding, upstream stantions 33 and downstream by downstream stantions 33*a*, to which the beams 32 are appropriately bolted by bolts 34. The downstream stantions 33*a* also support the upstream or entrance end of the frame 26 adjacent to the first roller 22*a* of the infeed conveyor 12.

Beams 31 support a plurality of pillar blocks, such as blocks 35, arranged in transversely opposed pairs, so as to support a plurality of spaced, parallel, transversely extending fluted roller shafts 36. The shafts 36 are simultaneously driven at the same speed by means of a plurality of outer and inner sprockets 37 and 38, respectively connected in pairs to the ends of the shafts 36, outwardly of the pillar blocks 35. Preferably the outer sprockets 38 are arranged in transversely aligned, adjacent pairs on shafts 36 so that endless outer chains 40, best seen in FIGS. 4 and 5, encompass longitudinally aligned, adjacent pairs of the outer sprockets 37 while endless inner chains 39 encompass adjacent, longitudinally aligned pairs of inner sprockets 37 so that all of the sprockets 37 and 38 are rotationally driven synchronously. Outer chains 40 are driven by a motor (not shown).

Figure 4:
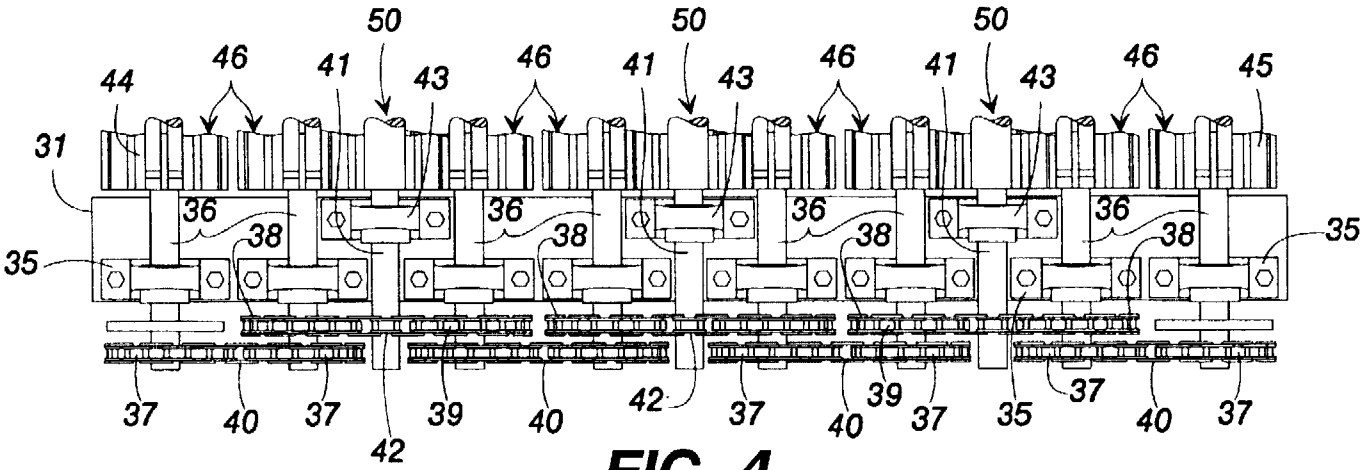
FIG. 4 is a cross-sectional view taken substantially along line 4—4 in FIG. 3.
Figure 5:
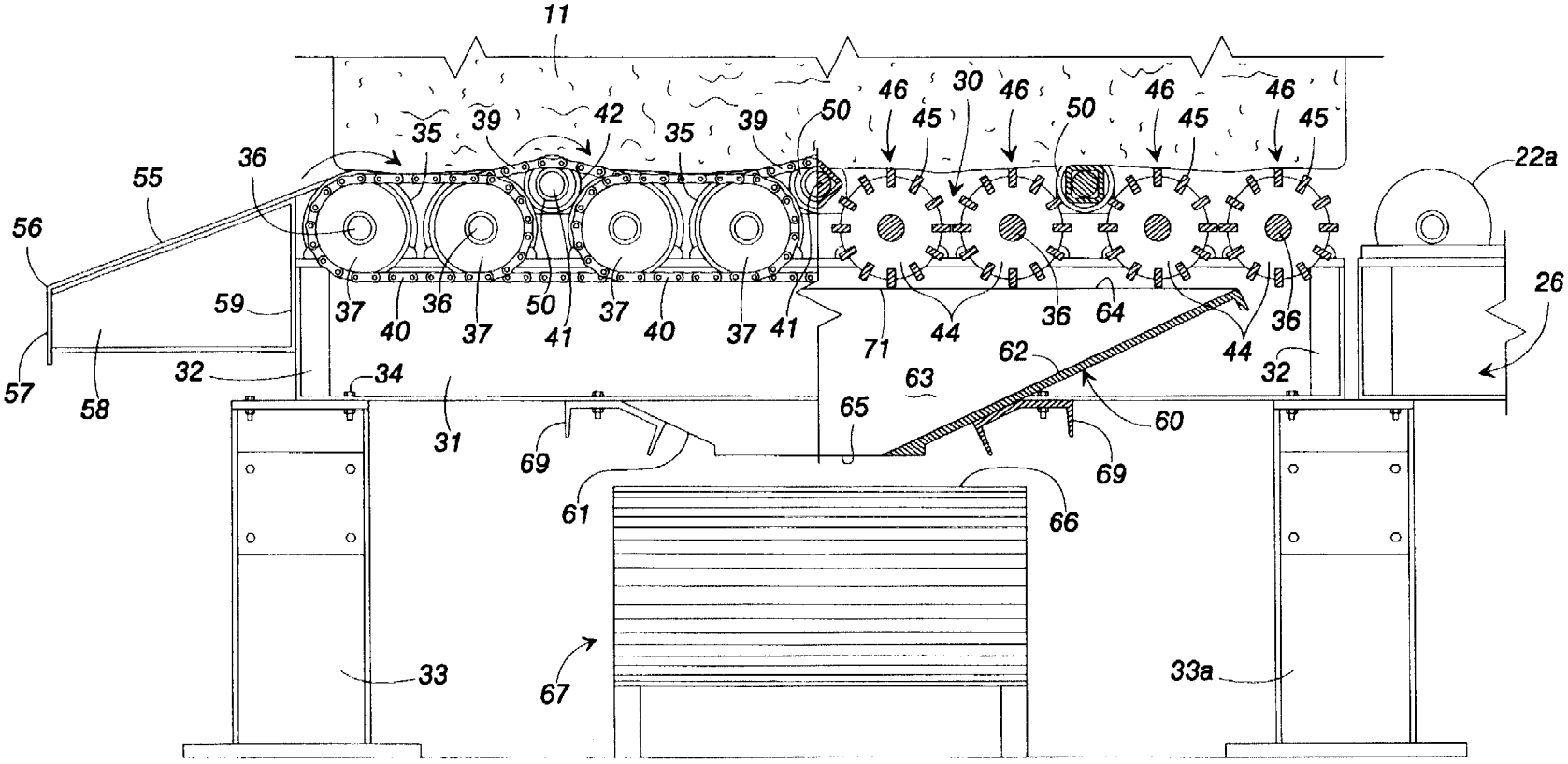
FIG. 5 is a cross-sectional view taken substantially along line 5—5 in FIG. 2 and showing essentially the cleaning bed section of the module handler shown in FIG. 1.

In FIGS. 4 and 5, it is seen that the inner chains 39 also pass over and drive the smaller sprockets 42 which are carried by transverse shafts 41 supported by pillar blocks, such as pillar blocks 43, on longitudinal beams 31.

Each of the shafts 36 is provided with a fluted roller 46 which includes a cylindrical drum 44 extending transversely, essentially across the entire width of the cleaning bed section 30, between the pillar blocks 35. The length of drums 44 are thus longer than the width of modules 11. These cylindrical drums 44 are preferably solid pipes or rods which have an outside diameter of approximately 6⅝ inches. Recessed and fixed into circumferentially spaced, axial grooves in these drums 44 are a plurality of equally spaced, radially extending, outwardly protruding, rectangular bars, slats or rods 45, each of which protrudes approximately 1½ inches from the periphery of the drum 44. Each such drum 44 is provided with between approximately eight (8) and approximately twelve (12) equally spaced bars 45. These bars 45, if desired, can be cylindrical rods, welded in place on drum 44. A solid periphery for drum 44 is not essential since spaced discs (not shown) can function to support the circumferentially spaced bars 45, if desired. It is believed that the rectangular bars 45, the periphery of which is defined by the outer extremities or edges 45*a* of the bars 45, are preferred. The bars 45 and cylindrical drum 44 form the non-round fluted roller, denoted generally by the numeral 46.

The spacing of the slats or bars 45 circumferentially along the periphery of the drum 44 is quite significant in that if there are too many slats or bars 45 so that they must be spaced close to one another, the valleys between adjacent slats or bars 45 may fill up with cotton fibers and dirt, sand, debris, etc., sufficiently that the non-round fluted roller 46 will act as a round, continuously cylindrical roller. On the other hand, if there are not enough slats or bars 45, the spacing of bars 45 will be so far apart that the fluted rollers 46 may not adequately work the bottom of the module 11. Hence, there should be a sufficient number of bars 45 (usually 8 to about 12) for the slats or bars 45 to agitate and impart adequate working action on the bottom portion of the modules 11, so as to raise or lower increments of the bottom surface and/or to provide a pulling action on the bottom fibers, as will be explained more fully, hereinafter.

Figure 7:
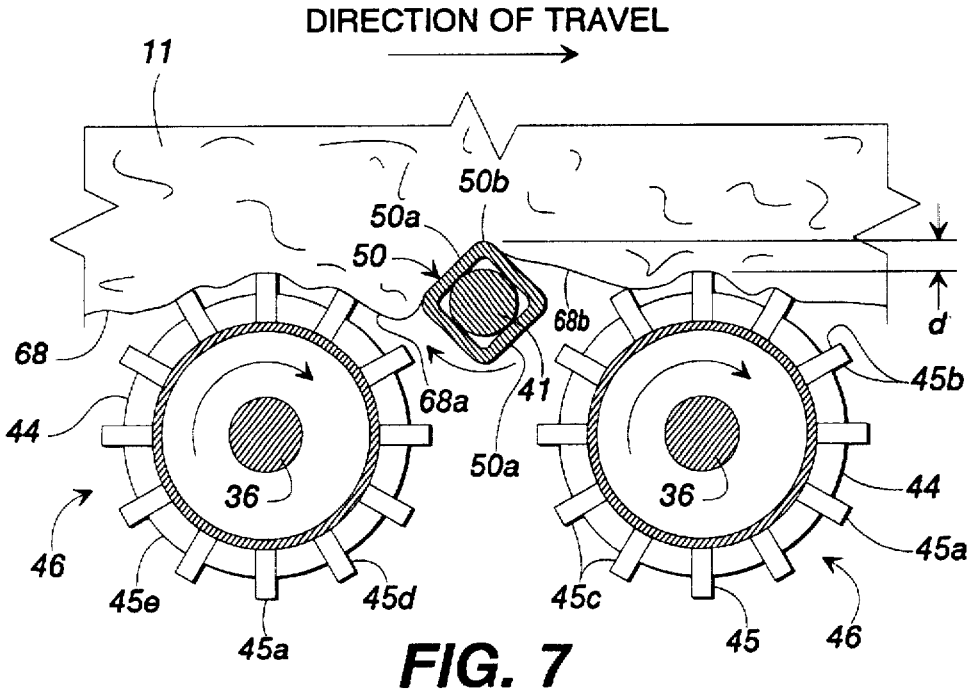
FIG. 7 is an enlarged, schematic, fragmentary, side elevational view of a portion of the cleaning bed section shown in FIG. 2.

Mounted on each of the shafts 41 is beater roller 50, preferably formed from a rectangular or square tubular, hollow rod. As best seen in FIGS. 5, 6 and 7, each beater roller 50 is interposed in a raised position between adjacent fluted rollers 46 so that there are usually two fluted rollers 46, then a raised beater roller 50, followed by two fluted rollers 46, and a second beater roller 50, etc. If desired, these rollers 46, 50 can constitute the entire infeed conveyor 12 or be interposed with the cylindrical rollers 22.

The beater rollers 50 are each formed of a plurality of flat rectangular plates or slats 50*a*, the edges of which are integrally joined to adjacent flat slats 50*a* at angles of 120° or less, so as to provide a plurality of 3 to about 6 apexes or peaks 50*b* which are straight and parallel to each other and to shafts 41 so that peaks 50*b* extend longitudinally throughout the length of the roller 50. The outer surfaces of the apexes or peaks 50*b* are slightly rounded so that they merge into the surfaces of the adjacent pair of slats 50*a*. These slats 50*a* are preferably formed of a 2 inch square tube so as to provide about a ½ inch lift d (FIG. 7) between edge 45*a* and peak 50*b* at the peripheries of rollers 50 and 46 respectively, when rotating, such that a transverse bottom increment of the module 11 is engaged by the apex 50*b* at ½ inch above edge 45*a*. The lift d on module 11 between the edge 45*a* and the apex 50*b* can be about ¼ inch to about 1 inch. Since the beater rollers 50 are relatively small, being formed of 2 inch square tubes, each roller 50 will usually sag under the weight of a module 11 so that the ½ inch lift d on module 11 will be only about ¼ inch in the middle portion of module 11. Preferably the beater rollers are 90° out of phase with each other, as shown in FIGS. 5 and 6. Both the fluted rollers 46 and the beater rollers 50 are non-round, having circumferentially spaced, straight transverse portions, such as flat plate 50*a* of roller 50 and edges 45*a* of roller 45, which simultaneously engage spaced transverse increments of the bottom of each module 11. These spaced transverse portions 45*a* and 50*a* engage spaced transverse portions of the bottom of modules 11.

Usually the infeed conveyor 12 and hence, the fluted rollers 46 and the beater rollers 50 should provide a conveying width of about 117 inches. Such a width is substantially wider than the width of the modules 11. The distance between the axes of adjacent shafts 36 should be about 7 inches, provided there is no intervening transversely extending shafts 41 of the beater rollers 50. Where there is such an intervening shaft 41, the space between the axes of adjacent shafts 36 should be about 8⅝ inches. Thus, the distance between the axes of an adjacent shaft 36 and shaft 41 should be about 4⁵⁄₁₆ inch.

As best seen in FIGS. 3, 4 and 5, the upstream end of the cleaning bed section 30 is provided with a stationary inclined slide plate 55 leading to the upper working surface of section 30. The forward end of plate 55 is bent at numeral 56 to provide a vertical nose plate 57. This slide 55 is supported by a pair of brackets, such as bracket 58, in FIG. 5. Each bracket 58 has a flange 59 which abuts the front surface of the front cross bar 32 and is fixed thereon so as to support the inclined plate 55, with its rear portion protruding over a portion of the frontmost fluted roller 46 in the cleaning bed section 30. When the modules are delivered in a truck (not shown) from the field or from their storage area, the truck will back in over a portion of the inclined slide plate 55. There are chain conveyors (not shown) within the truck which extend over the plate 55 so that, when the modules 11 are discharged, the modules 11 will be received on the fluted rollers 46 which are disposed adjacent to the slide plate 55.

In operation, modules 11 are initially received at the infeed end or upstream end of the cleaning bed section 30 and are progressively conveyed to the downstream end of the cleaning bed section 30, being, thence, transferred to the upstream or entrance end of the infeed rollers 22, 22*a* so that each module 11 passes along the infeed conveyor 12 until it is urged by rollers 22 against the disperser drums 15, shown in broken lines in FIG. 1. The fluted rollers 46 and the beater rollers 50 are rotated at a speed such that the modules 11 are advanced toward the head 10 at about 40 to 50 feet per minute.

The shafts 41 are arranged with respect to the shafts 36 so that the maximum diameter of the beater rollers 50 will be a distance of about ½ to 1½ inch above the periphery of the bars 45 of the rollers 46. Furthermore, it is preferred that the beater roller 50 be formed of a ¼ inch thickness steel and be approximately 2 inches in width along each side.

It will be understood that by passing the chain 39 across the top of sprockets 42, it will enable the beater rollers 50 to be rotated in the same direction as fluted rollers 46 but at a lower peripheral speed than the peripheral speed of rotation of the fluted rollers 46. Thus, when the module 11 is resting by its bottom portion on these rollers 46 and 50, as shown, the fluted rollers 46 will act upon the bottom surface of the module 11 so as to tend to beat, agitate, flex, compress and stretch the fibers at the bottom portion of each of the modules 11.

The fibers 68 along the lower portion of each module 11 are in random orientation with respect to each other and capture and hold the particles of debris in the interstices created by these fibers 68. The fluted rollers 46, each have the radially protruding bars 45, the ends 45*a* of which are perpendicular to the opposed parallel side surfaces 45*b* of its bars 45, so as to intersect these surfaces 45*b* respectively at 90°, thereby forming straight, parallel, beveled leading and trailing edges 45*c*. When the module 11 is moved by roller 46, the edges 45*c* dig into the fibers 68 along spaced transverse increments of the bottom of module 11, tending to lift fibers 68 and move them in an arcuate path, forwardly so as to urge the module 11 in a downstream direction along section 30. The lifting and urging of these spaced increments of fibers 68 causes a stretching of the longitudinally oriented fibers, to a greater extent than the transversely oriented fibers and also tends to compact the fibers into the module 11. This results in a shifting of fibers 68 and a readjustment of the interstices which contain the solids, such as the sand, dirt, trash and debris (contaminants), causing them to migrate and drop by gravity into the grooves or flutes 45*e* between adjacent bars 45, so as ultimately to be transported to the lower flights of the fluted rollers 46 whence the solids drop out of the grooves 45*e*.

These same stretched transverse increments of fibers 68 may then pass to a second fluted roller 46 or to the beater roller 50, as illustrated in FIG. 7. In passing to a second fluted roller 46, the fibers are subjected to a second stretching action, before passing to a beater roller 50.

It will be remembered that the beater rollers have a lower peripheral speed for the peaks 50*b* than the peripheral speed of the outer ends 45*a* and edges 45*c*. Hence, there will be a lag in the travel of stretched fibers 68 so that they form progressive sagging transverse increments of fibers 68*a* in FIG. 7, which are subsequently delivered to the beater roller 50.

In traveling from roller 46 to roller 50, the fibers 68*a* are beat and flexed to permit additional debris to be released from the shifting fibers.

The beater roller 50, as the name implies, applies a beating action on the fibers 68*a* to urge them back into a compressed condition as successive, compressed, transverse increments of fibers 68*b*.

The flat plates or slats 50*a* have a beating action which successively urges the fibers together while the peaks or apexes 50*b* tends to urge the fibers forwardly. The lower peripheral speed of beater roller 50, with respect to the second or downstream roller 46, will have a stretching action on fibers 68*b* so that between beater roller 50 and downstream roller 46, the transverse increments of fibers, designated fibers 68*b*, are relatively taunt and are again stretched in passing from roller 50 to downstream roller 46. Further stretching is applied to such successive increments by the successive bars 45 of downstream roller 46.

The successive compressions and bending of the fibers 68 causes a progressive change in fiber orientation so as to release the solids.

If it is desired to increase the action of the beater rollers 50, the chains 39 can be passed beneath the sprockets on the shafts 41, as shown in FIG. 6, thereby causing a rotation of the shafts 41 in a direction opposite to the direction of rotation of the shafts 41 in FIG. 5. This rotation of the shafts 41 in an opposite direction increases the beating and stretching of the fibers 68 as they pass over the beater rollers 50.

As best seen in FIGS. 5 and 6, a contaminants receiving tray 60 is disposed below the rollers 46 and 50 of the cleaning bed section, this tray 60 being formed with downwardly converging flat front plate 61 and back plate 62. The side edges of these generally rectangular plates 61, 62 are joined by trapezoidal shaped side plates 63 so as to provide a wide rectangular mouth 64 extending between substantially all of the rollers 46 and 50, and converging to a discharge opening 65 so as to deliver all of the contaminants onto the upper flight 66 of a transverse conveyor, denoted generally by the numeral 67. Channel shaped support bars 69 extend between opposed portions of the beams 31 so as to support the trash tray 60 in place, as shown in FIGS. 5 and 6.

The cross conveyor 67 has a continuous belt 68 which moves in a horizontal path beneath the spout or discharge opening 65 of the trough 60 so as to progressively accumulate the contaminants 70 and transport this debris 70 initially in a horizontal path and then at an incline as depicted in FIG. 1 so as to dump the trash and debris into a receptacle or container 80 disposed along side the cleaner bed section 30.

The added portion of the present invention includes a cleaning trough or sieving trough, denoted generally by numeral 90. This trough 90 is beneath a transverse auger or screw conveyor 85 within the cotton clump receiving chamber 90*a*, defined by feeder head 10, as depicted in FIG. 1. Cleaning trough 90 is positioned transversely within feeder head 10, substantially between the lower portion of end plate 14 of feeder head 10 and the lower-most disperser drum 15. This transverse trough 90 defines the bottom portion of chamber 90*a*. Thus, clumps of cotton which are dispersed from a seed cotton module 11 by disperser drums 15 are delivered into chamber 90*a*, where conveyor 85 moves the clumps of cotton laterally into air separator box 16 for subsequent delivery to a cotton gin.

Though a large amount of dirt is removed from the bottom portion of cotton module 11 by cleaning bed section 30, as described hereinbefore, an undesirable amount of contaminates typically remain within the seed cotton fibers of module 11, which, if not removed, will abrade the elbows and fan of duct 17. To enable the removal of such contaminates, a portion of trough 90 is provided with a grate or sieve 91 for permitting the separation of sand and dirt from the clumps of dispersed cotton, as the clumps are being removed from chamber 90*a* by conveyor 85.

In the preferred embodiment, the grate or sieve 91 comprises a plurality of equally spaced parallel rods 92 in a concaved arcuate array about the bottom portion of auger 85. Rods 92 are preferably round bars with a diameter of ⅜ inch, though it can be appreciated by one skilled in the art that rod 92 can take many other forms other than round bar, such as square, trapezoidal or other multi-sided bar shapes. Because rods 92 run parallel with screw conveyor 85 throughout substantially the entire trough 90, there is less resistance on the clumps of cotton as they are being moved laterally toward air box 16 which reduces the degradation of the cotton fibers. Further, the rods 92 being parallel to the axis of rotation of conveyor 85 assists in guiding the flow of the clumps, thereby allowing them to move more freely in trough 90.

Important to retaining the cotton in trough 90 is the spacing between adjacent rods 92, which define slots 114 extending longitudinally along trough 90 and through which contaminants pass by gravity. If the slots 114 are too small, it will inhibit the removal of the contaminants. Conversely, if the slots 114 are too large, the dispersed cotton and cotton seeds will tend to pass between rods 92 and hang up, so as to clog screw conveyor 85. Accordingly, it is preferred that adjacent rods 92 be spaced approximately 0.125 and 0.4 inches apart. In the preferred embodiment, the spacing between adjacent rods 92 is 0.25 inches. Worth noting is that the air draft or vacuum in duct 17 which acts to draw the cotton clumps, dispersed from module 11, into air chamber 90*a* and through air separator box 16 to the gin, also creates an air draft through sieve 91 into air chamber 90*a* which serves to depreciate the loss of cotton through sieve 91. By incorporating sieve 91 in a selective portion(s) of trough 90, the air draft through slots 114 may be controlled so as to enhance the removal of contaminants and/or decrease the loss of cotton.

Figure 8:
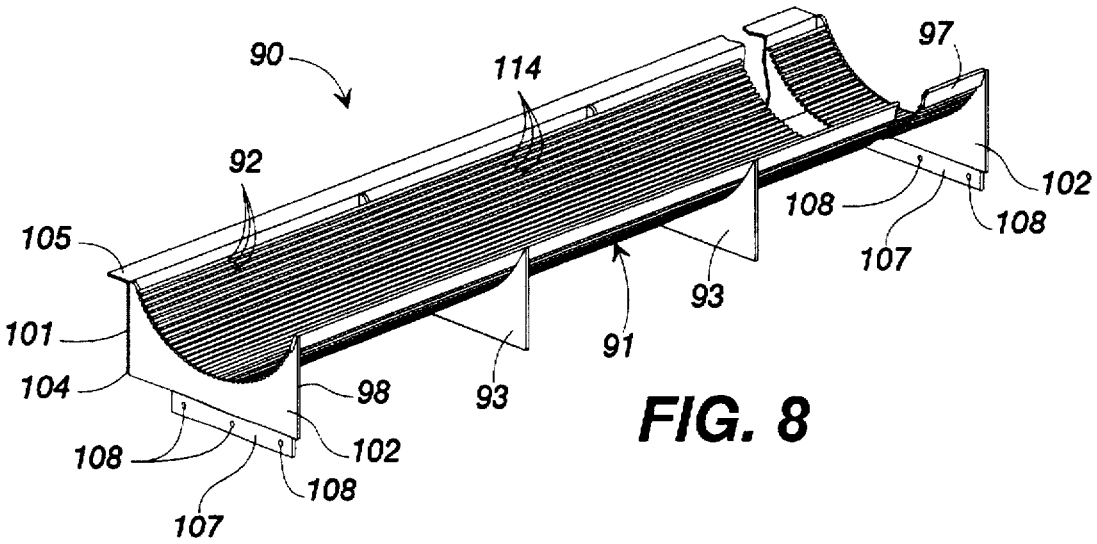
FIG. 8 is a perspective view of the cleaning trough of the cotton handler depicted in FIG. 1.
Figure 9:
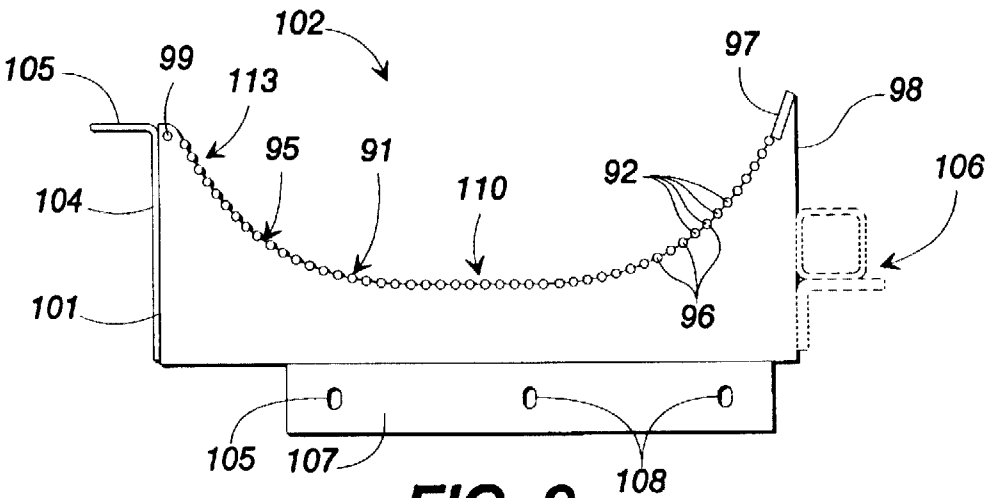
FIG. 9 is a front elevational view of the cleaning trough of FIG. 8.

Rods 92 are held in place by laterally spaced, U-shaped rod mounts 93 and end rod mounts 102, which are transversely dispersed beneath conveyor 85 for receiving the rods 92, as shown in FIG. 8. Rod mounts 93, 102 are respectively made of 0.25 inch sheet metal, preferably cut with a precision cutting instrument such as a laser. In the top portion of each of rod mounts 93, 102 is an arcuate edge 95 which is concaved for receiving screw conveyor 85. Disposed along substantially the full length of edge 95 are a plurality of equally spaced upwardly and outwardly opening notches 96 configured to receive and hold rods 92 in an arcuate array. Specifically, each notch 96 is configured to receive a lower peripheral increment of each rod 92. Thus, the upper peripheral portion of each rod 92 extends upwardly past edge 95, as seen in FIG. 9. Rods 92 are preferably welded in notches 96 to strengthen the structure of trough 90

An elongated flat bar 97 extends parallel and adjacent to the outermost rod 92, the bar 97 being secured to the upper end portions of rod mounts 93 and 102. Flat bar 97 is provided to span the gap between sieve 91 and the last downstream roller 22 (not shown) of conveyor 12, located adjacent to trough 90. On the other upper end portions of mounts 93 and 102 are aligned holes 99 for receiving a rod 92 which prevents cotton from falling between end plate 14 and trough 90.

Trough 90 is mounted in a fixed position in air chamber 90*a* of feeder head 10 by an angle iron cross bar 104 mounted between beams 19 and secured to the aligned front edges of mounts 93 and 102. A second cross bar 106, shown in broken lines in FIG. 9, supports the rear edges of mounts 93 and 102. Additional support can be provided by fastening mounting brackets 107 to the beams 19 through apertures 108.

As best seen in FIG. 9, trough 90 is concaved in cross-section, having a relatively flat central portion 110 and opposed arcuate side portion 113 which curve outwardly and upwardly from the central portion of sieve 91. This enables trough 90 to encompass the lower portion of the circular periphery of the helical blade of auger 85 when the central shaft of auger 85 is supported at its end portions for rotation by pillow blocks (not shown) and is driven by motor M2. By the central flattened concaved contour of trough 90, the central portion 110 of trough 90 is closer to the rotating periphery of auger than the opposed, concaved, side portions 111 of trough 90. There should be a minimum vertical central clearance between the trough 90 and the auger 85 of about 0.2 inches (5 mm) to about 1.25 inches (31 mm), and preferably about 0.25 inches (6 mm). There should also be greater side clearances between side portions 111 and the blade of auger 85. The additional side spaces prevents clogging of conveyor 85, by providing more space for the clumps of cotton to be tumbled as they are conveyed by auger 85 within trough 90. This is particularly useful when the conveyor 85 is a screw conveyor since they typically lift or shift the clumps of cotton to one side of the trough 90 as the cotton is being conveyed from chamber 90*a*.

In operation, the cotton dispersed from successive modules 11 is drawn and thrown into clump chamber 90*a* so as to be received in trough 90 at the bottom of chamber 90*a* where conveyor 85 conveys it progressively toward air separator box 16. As the cotton is being conveyed across sieve 91 in a tumbling motion, contaminants 112 released from the tossed and tumbled cotton fibers passes by gravity or sieves through the spaced parallel slots of sieve 91 where it falls to the ground, as shown in FIG. 1 at numeral 112. To enhance the release of contaminants from the dispersed cotton, a suctioning means (not illustrated), such as a fan, may be coupled to the underneath side of trough 90 by a conduit (not illustrated) so as to draw or pull the lighter weight contaminants from the cotton. The amount of suctioning applied may be selectively controlled by valves or doors (not shown) provided in the conduit. This may tend to draw more cotton through sieve 91 but by controlling the amount of vacuum and positioning of sieve 91 about trough 90, the loss of cotton should be minimal. Further, a receiving tray (not shown) and cross conveyor (not shown), as utilized within cleaning bed section 30, may be disposed below trough 90 for collecting the contaminants 112 which passed through sieve 91.

The sieve 91 of trough 90 terminates at a discharge hole 120 communicating with the interior of the air separator box 16. A vacuum drawn on duct 17 causes air to be progressively drawn through the discharge hole 120, then swirled in air separator box 16 and thereafter drawn from a side of the air separator box 16 into duct 17. Still additional contaminants (not shown) fall by gravity to the bottom of chamber 16 as the loosened cotton clumps are drawn into duct 17.

Figure 10:
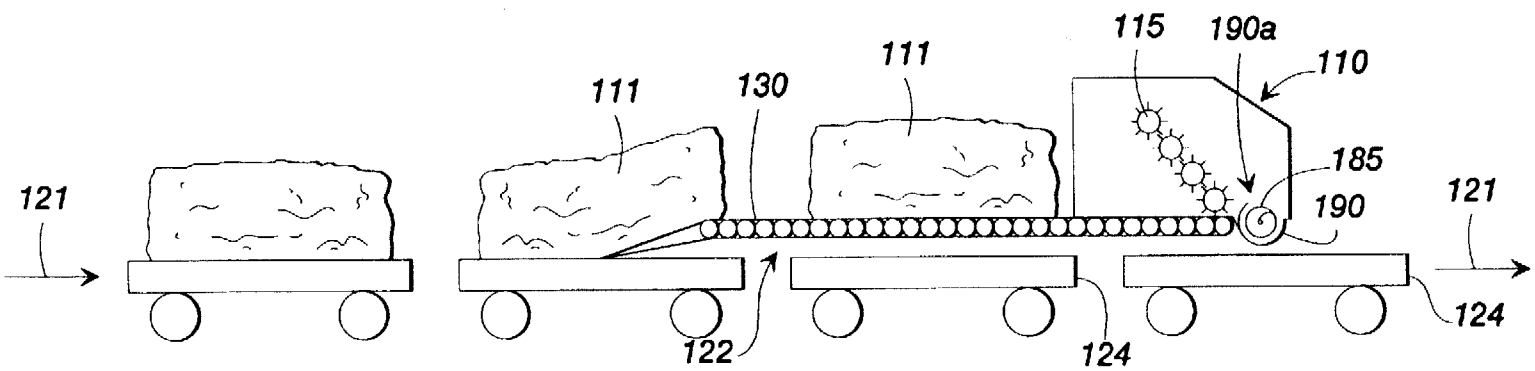
FIG. 10 is a schematic view of a trash separator system in accordance with the present invention in use with a cart delivery system.

As can be appreciated by one skilled in the art, the trash separation system of the present invention can be used in conjunction with a cart delivery system as illustrated in FIG. 10. In FIG. 10, carts 124 are utilized to deliver cotton modules 111 to feeder head 110 in the manner shown. A more comprehensive discussion of such a cart delivery system can be found in patent application Ser. No. 08/388,260, filed on Feb. 13, 1995, entitled "Seed Cotton Module Handler With Trash Separator," the disclosure of which is incorporated herein by reference. As carts 124 progress toward feeder head 110 in the direction indicated by arrows 121, a conveyor 122 removes the cotton modules 111 from carts 120 and delivers the modules 111 to feeder head 110 where the cotton modules 11 are dispersed by disperser drums 115 at the downstream and of conveyor 122. Incorporated into the upstream portion of conveyor 122 is a cleaning bed section 130 in accordance with the description herein before of cleaning bed section 30. As with cleaning bed section 30, section 130 can be located anywhere along conveyor 122. The clumps of cotton (not shown) dispersed from a cotton module 111 by drums 115 are received in trough 190 which defines the bottom of cotton clump receiving chamber 190*a* at the rear of feeder head 110. An auger or screw conveyor 185 transversely disposed in feeder head 110, parallel to and received in trough 190, urges the cotton clumps laterally into an air separator box (not shown) for subsequent delivery to the gin.

In this embodiment, sand and dirt released from the cotton clumps in trough 190 pass through sieving means in trough 190 and are collected on a cart 124 passing beneath trough 190. The sand and dirt is subsequently removed from cart 124.

It will be obvious to those skilled in the art that many variations may be made in the embodiment herein chosen for the purpose of illustrating the present invention, without departing from the scope thereof, as defined by the appended claims.

We claim:

1. A cotton module handler for removing contaminants from cotton modules having compacted bottom portions as the cotton modules are conveyed along a prescribed path toward a disperser which reduces the cotton modules progressively into clumps of cotton which are discharged into a clump chamber and wherein the clumps are further passed along a second path toward a cotton gin, the improvement comprising:

an infeed conveyor positioned upstream of the disperser, said infeed conveyor including a cleaning bed section which engages and agitates the bottom portion of each cotton module for causing the cotton to release the contaminants retained within the bottom portion of each cotton module;

means, positioned downstream of the disperser, for removing the contaminants from the clumps of cotton deposited within the clump chamber and for conveying the clumps of cotton along the second prescribed path toward the gin; and an air separator box for receiving the clumps of cotton from the second path and for subjecting the cotton clumps to agitation and for passing the clumps along a third path to the gin, said agitation being sufficient to separate additional contaminants from the cotton during the travel of the cotton clumps along said third path of travel.

2. The cotton module handler as claimed in claim 1 wherein said means for removing the contaminants from the clumps of cotton and for conveying the clumps of cotton comprises an auger transversely disposed within the clump chamber.

3. The cotton module handler as claimed in claim 2 wherein said means for removing the contaminants from the clumps of cotton and for conveying the clumps of cotton further comprises a sieve disposed beneath said auger within the clump chamber.

4. The cotton module handler as claimed in claim 3 wherein said sieve comprises a trough having a grate disposed therein, the grate including a plurality of spaced parallel rods arcuately arrayed about a portion of the auger, the grate being constructed and arranged to permit the passage of the contaminants therethrough while retaining the cotton for passage to said air separator box.

5. The cotton module handler as claimed in claim 1 further comprising a cart delivery system including a plurality of wheeled carts constructed and arranged to carry the cotton modules to the infeed conveyor as the carts are moved along the prescribed path.

6. The cotton module handler as claimed in claim 5 wherein the carts continue to travel beneath said infeed conveyor past said means downstream of the disperser for removing the contaminants from the clumps of cotton deposited within the clump chamber to capture the contaminants released and separated from the cotton.

7. A system for removing contaminants from cotton as cotton modules are conveyed along a path of travel through a feeder head having a disperser which reduces the cotton modules to clumps of cotton for delivery to a cotton gin, said system comprising:

an infeed conveyor including a plurality of spaced rollers positioned upstream of the disperser, the rollers being constructed and arranged to agitate the cotton modules so as to dislodge a portion of the contaminants from the cotton modules as said infeed conveyor moves the cotton modules along the predetermined path toward the disperser;

a clump chamber defined within the feeder head downstream of the disperser, said clump chamber including an elongate upwardly opening sieve transversely mounted beneath the disperser within the feeder head, the sieve being constructed and arranged to capture the clumps of cotton reduced by the disperser while allowing additional contaminants to pass therethrough, and an auger partially disposed within the sieve, the auger being constructed and arranged to laterally move the clumps of cotton along the predetermined path within the sieve thereby agitating the clumps of cotton to separate additional contaminants therefrom; and an air separator box downstream of and in communication with said clump chamber, said air separator box being constructed and arranged to receive the clumps of cotton laterally moved along the sieve by the auger and to agitate the clumps of cotton to separate additional contaminants therefrom as the clumps of cotton are passed along the predetermined path to the cotton gin.

8. The system as claimed in claim 7 wherein said infeed conveyor further includes a cleaning bed section having a plurality of spaced beater rollers rotated at a first peripheral speed and a plurality of fluted rollers rotated at a second peripheral speed.

9. The system as claimed in claim 7 wherein the sieve comprises a trough having a plurality of equally spaced parallel rods extending along the length of said trough.

10. The system as claimed in claim 9 wherein said auger has an axis of rotation and wherein the rods extend parallel to, and at least partially about the axis of rotation of the auger in a concave arcuate array.

11. The system as claimed in claim 7 further comprising a contaminant receiving tray disposed beneath said infeed conveyor, and a cross conveyor disposed below said contaminant receiving tray, wherein the contaminants dislodged by said infeed conveyor pass between the spaced rollers thereof and are directed through said contaminant receiving tray to said cross conveyor for transport away from the pre-determined path.

12. A method for removing contaminants from cotton as cotton modules having compacted bottom portions are conveyed along a path of travel through a feeder head having a disperser therein which reduces the cotton modules to clumps of cotton for delivery to a cotton gin, said method comprising the steps of:

a) moving the cotton modules along the path of travel along an infeed conveyor positioned upstream of the disperser, the infeed conveyor including a plurality of spaced rollers, constructed and arranged to agitate the bottom portions of the cotton modules to dislodge a portion of the contaminants therefrom;

b) moving the cotton modules toward a clump chamber downstream of the disperser, the clump chamber having an open end within the feeder head and including an elongate upwardly opening sieve transversely mounted beneath the disperser within the feeder head, and an auger partially disposed within the sieve;

c) receiving the clumps of cotton, reduced by the disperser, within the sieve;

d) separating additional contaminants from the clumps of cotton by rotating the auger within the sieve;

e) passing the clumps of cotton to the open end of said clump chamber;

f) forcing an air draft through said clump chamber and into an air separator box adjacent the open end of said clump chamber;

g) entraining the clumps of cotton delivered to the open end of said clump chamber in the air draft; and h) swirling the clumps of cotton in said air separator box to remove additional contaminants from the clumps of cotton as the clumps of cotton are delivered in the predetermined path to the cotton gin.

13. The method as claimed in claim 12 wherein step a) further comprises the step of passing the cotton modules over a cleaning bed section of said infeed conveyor.

14. The method as claimed in claim 12 wherein the sieve includes a trough, and wherein step (d) further comprises the step of passing the separated contaminants out of said clump chamber and away from the pre-determined path through a plurality of equally spaced parallel rods extending along the length of the trough in a concaved arcuate array at least partially about the auger within the sieve.

15. The method as claimed in claim 12 further comprising the steps of: loading the cotton modules onto said infeed conveyor with a cart delivery system, said cart delivery system including a plurality of wheeled carts moved along the pre-determined path;

passing the wheeled carts beneath said infeed conveyor along the predetermined path;

collecting the contaminants dislodged by the rollers on the wheeled carts;

passing the wheeled carts along the pre-determined path beneath said clump chamber;

receiving the contaminants separated from the clumps of cotton in the sieve on the wheeled carts; and moving the wheeled carts carrying the contaminants away from the pre-determined path.

16. A cotton module handler for removing contaminants from a cotton module as a series of cotton modules are carried on an infeed conveyor, the infeed conveyor having a cleaning bed section for separating and removing a portion of the contaminants from the modules, through a disperser disposed within a feeder head which reduces the cotton modules to clumps of cotton which are discharged into a clump chamber, and wherein the clumps are further passed through an air separator box for separating and removing additional contaminants from the clumps of cotton as the clumps of cotton are moved by an air stream toward a cotton gin, the improvement comprising:

an upwardly opening sieve transversely mounted on the feeder head within the clump chamber, said sieve being mounted beneath the disperser and being constructed and arranged to capture the clumps of cotton reduced by the disperser while allowing additional contaminants to pass therethrough; and an auger having a transverse axis of rotation, said auger being partially disposed within said sieve and being constructed and arranged to agitate and laterally move the clumps of cotton within the sieve as said auger is rotated about its transverse axis, wherein additional contaminants are separated from the clumps of cotton as the clumps of cotton are passed through the open end of said clump chamber.

* * * * *